United States Patent [19]

Cooper

[11] Patent Number: 4,772,234

[45] Date of Patent: Sep. 20, 1988

[54] TERMINAL FOR ESTABLISHING ELECTRICAL CONTACT WITH A POST

[75] Inventor: Ralph M. Cooper, Clemmons, N.C.

[73] Assignee: AMP Incorporated, Harrisburg, Pa.

[21] Appl. No.: 79,370

[22] Filed: Jul. 29, 1987

[51] Int. Cl.[4] ..... H01R 13/11

[52] U.S. Cl. ..... 439/851; 439/398

[58] Field of Search ..... 439/391, 392, 395, 397, 439/398, 851, 856

[56] References Cited

U.S. PATENT DOCUMENTS

| | | |
|---|---|---|
| 3,123,428 | 3/1964 | McKee . |
| 3,503,036 | 3/1970 | Desso et al. . |
| 3,670,288 | 6/1972 | Evans . |
| 4,159,158 | 6/1979 | Weidler . |
| 4,296,988 | 10/1981 | Warner . |
| 4,317,608 | 3/1982 | Dechelette . |
| 4,405,193 | 9/1983 | Weidler . |
| 4,408,824 | 10/1983 | Weidler . |
| 4,527,852 | 9/1985 | Dechelette . |
| 4,527,857 | 9/1985 | Hughes et al. . |
| 4,546,542 | 10/1985 | Proud . |
| 4,553,808 | 11/1985 | Weidler et al. . |
| 4,662,694 | 5/1987 | Coller et al. . |

FOREIGN PATENT DOCUMENTS 2390030 10/1981 France .

OTHER PUBLICATIONS

"AMP MTA Mass Termination Assemblies Printed Circuit Board Connectors", AMP Catalog 77-451, revised 5-86.

Molex Full Line Catalog No. 840, pp. 1H-33H.

*Primary Examiner*—Joseph H. McGlynn

*Attorney, Agent, or Firm*—Robert W. Pitts

[57] ABSTRACT

An electrical terminal has two arms which define a receptacle for a pin or post. At least one of the arms comprises a web extending to the pin-receiving end of the receptacle and which has sidewalls extending from its marginal side edge portions. A slot extends inwardly in the web from the pin-receiving end of the receptacle and divides the web into two sections, each of which consists of one of the sidewalls and the portion of the web extending from the sidewall to the slot. The opposed internal surfaces of the sidewalls are spaced apart by a distance less than the width of the pin so that when the pin is inserted, the two sections are each deflected and bear against the pin with contact forces. Each of the sections is elastically deformed by planar deformation of the sections away from each other in the plane of the web and also by torsional deformation. The resultant contact forces exerted on the pin are produced by the two modes of deflection and relatively high contact forces are achieved as a result.

21 Claims, 6 Drawing Sheets

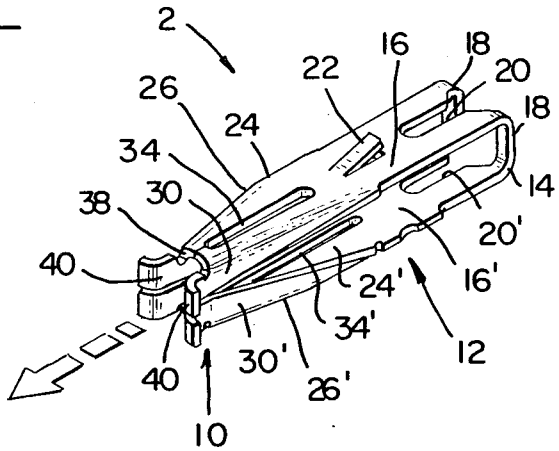
Fig. 1
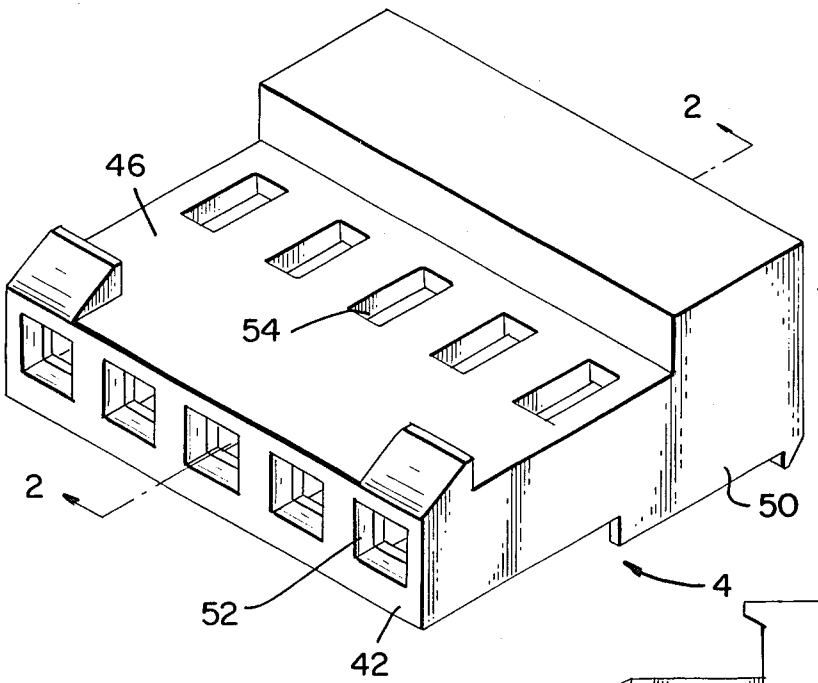
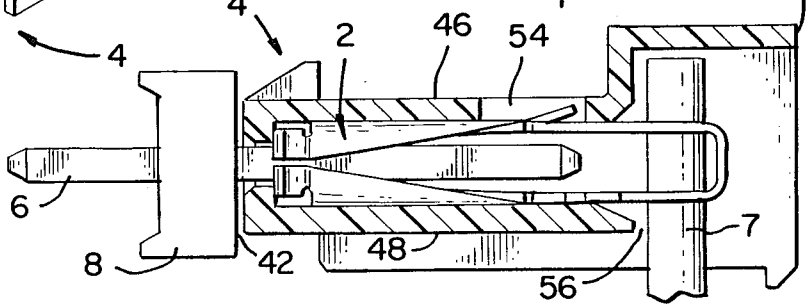
Fig. 2

TERMINAL FOR ESTABLISHING ELECTRICAL CONTACT WITH A POST

FIELD OF THE INVENTION

This invention relates to stamped and formed electrical terminals of the type having a receptacle portion comprising spring arms which are elastically deformed when a pin or post is inserted into the receptacle portion thereby to establish the contact forces which are exerted on the inserted pin.

BACKGROUND OF THE INVENTION

U.S. Pat. No. 4,159,158 discloses a stamped and formed electrical terminal having a pair of co-extensive arms, one of which is in the form of a cantilever spring so that when a pin or post is inserted into the space between the arms, the cantilever spring is deflected and establishes the contact force required for the terminal. Terminals of the type shown in U.S. Pat. No. 4,159,158, and similar terminals having two or more arms which define a receptacle, are widely used in many branches of the electrical industry. Terminals of these types can be manufactured at relatively low cost and are highly satisfactory, from a performance standpoint, when they are used within their limitations.

The maximum current which can be carried by terminals of the type previously described can be limited because the contact forces are limited to relatively low levels and, in some instances, the cross-sectional area of metal available for carrying the current is also limited.

The present invention is directed to the achievement of a terminal which may be of the type shown in U.S. Pat. No. 4,159,158 but which is also suitable for use under circumstances where a higher current carrying capacity is required. Particularly, the invention is directed to the achievement of a terminal having a spring arm type receptacle in which the material, the metal, in the spring arms is employed with a high degree of efficiency so as to develop a relatively high contact force on a pin or post with which the terminal is mated and to provide a maximum amount of material in the spring arms thereby increasing the cross-sectional area available for current-carrying purposes. The principles of the invention can be used in a variety of electrical terminals other than terminals of the general type shown in the above-identified U.S. patent.

THE INVENTION

The invention comprises an electrical contact terminal having an integral receptacle which is intended to receive a contact pin. The terminal is of stamped and formed sheet metal and the receptacle portion has a pin-receiving end and an inner end portion. The receptacle has internal surface portions and has receptacle contact portions on the internal surface portions which establish electrical contact with a contact pin upon insertion of the pin into the receptacle. The receptacle is characterized in that the receptacle comprises a web and opposed sidewalls on each side of the web, the web extending from a location adjacent to the pin-receiving end to the inner end portion. The sidewalls have opposed internal sidewall portions adjacent to the pin-receiving end and the receptacle contact portions are on the opposed internal sidewall portions. A receptacle slot is provided in the web which extends from the pin-receiving end at least partially to the inner end portion. The slot is located substantially medially between the sidewalls and serves to divide the receptacle into first and second side-by-side sections, each section comprising one of the sidewalls and a portion of the web which extends from the sidewall to the slot so that upon insertion of a pin into the receptacle, the leading end of the pin contacts the receptacle contact portions of the sidewalls and the receptacle is deformed or elastically deflected by planar deformation and stressing of the web in its own plane and additionally by torsional deformation and stressing of the first and second sections in opposite rotary directions with respect to the axis of the receptacle. After insertion of the pin, the receptacle exerts contact forces on the pin which are the summation of the contact forces exerted as a result of the planar stressing of the web and as a result of the torsional stressing of the sections.

In accordance with one embodiment, the receptacle comprises two arms which extend from an intermediate portion of the terminal to the pin-receiving end thereof. The receptacle, formed by the arms, has a receptacle axis which extends between the two arms from the pin-receiving end towards an intermediate portion of the terminal. At least one of the arms comprises a web having sidewalls and a centrally located slot as previously described which divides the web into two sections. When the pin or post is inserted into the receptacle, the two sections are deformed torsionally and the web is deformed by planar deformation as discussed above to produce the contact forces.

The two arms may be identical to each other or substantial mirror images of each other and be in opposed relationship. In this embodiment, four zones of contact are provided for the pin. In accordance with an alternative embodiment, only one of the arms has the two side-by-side sections while the other arm may comprise a flat, plate-like member.

THE DRAWING FIGURES

FIG. 2 is a cross-sectional view looking in the direction of the arrows 2—2 of FIG. 1 but showing the connector mated wtih a terminal pin and showing a wire connected to the terminal.

FIG. 3 is an enlarged perspective view of the terminal.

THE DISCLOSED EMBODIMENTS

Figure 1:
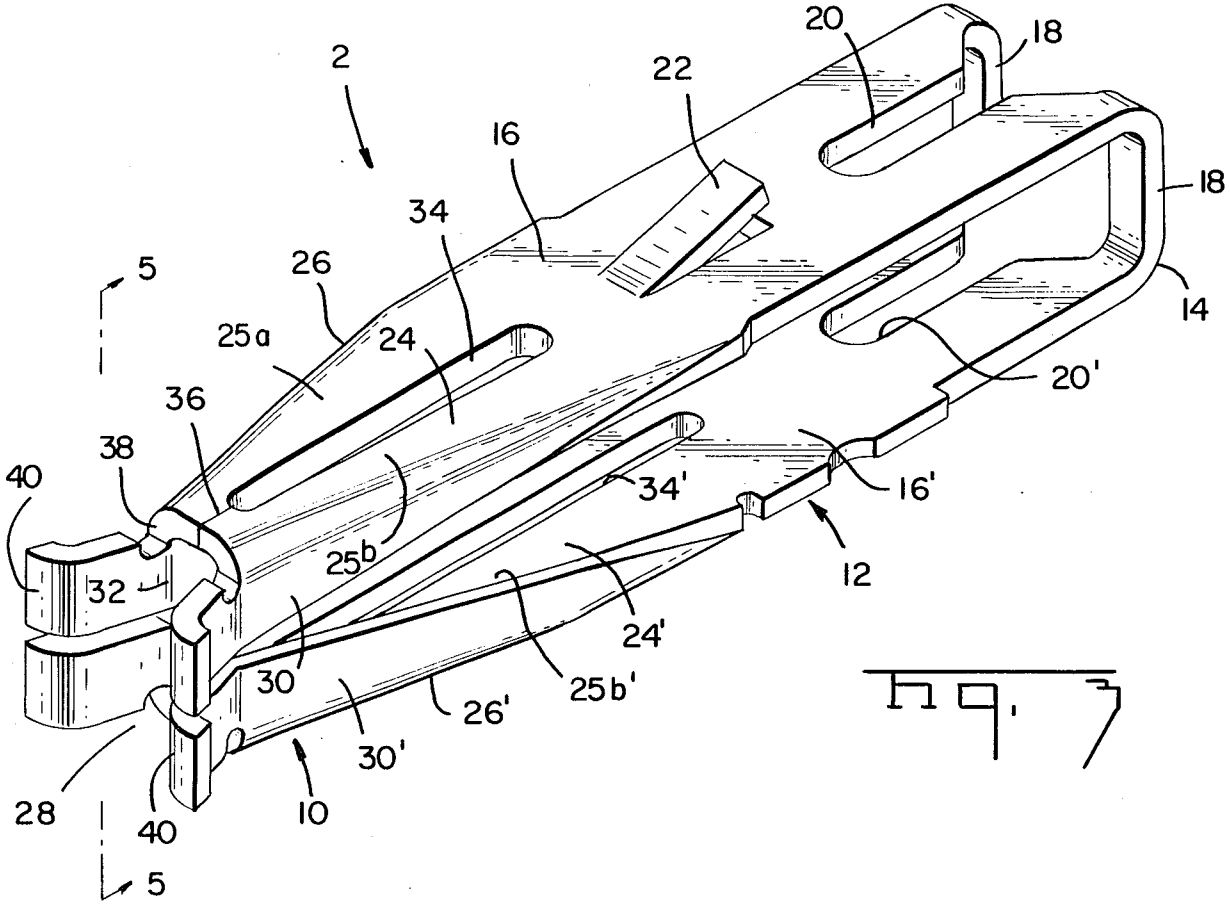
FIG. 1 is a perspective view of an electrical terminal in accordance with the invention exploded from a connector housing which is intended to receive the terminal.

FIG. 1 shows a terminal 2 in accordance with the invention exploded from an insulating housing 4 which contains a plurality of identical terminals in cavities 52. The housing containing the terminals is intended to be mated with terminal posts or pins 6 (FIG. 2) which are mounted in an insulating header 8. Ordinarily, the header is mounted on a circuit board or the like so that the protruding ends of the terminal pins can be soldered to conductors on the circuit board. When the connector is mated with the terminal pins and wires 7 are connected to the terminals, the wires will then be connected to the circuit board conductors.

The terminal 2 is of stamped and formed sheet metal such as brass or beryllium copper and comprises a receptacle end portion 10, an intermediate portion 12, and a connecting end portion 14 which is connected to the wire 7. The intermediate portion comprises parallel spaced-apart plate-like members 16, 16'. At the wire connecting end 14, the ends of these plates are connected by strap members 18. Wire-receiving slots 20, 20' are provided at the end portion for the wire 7.

The receptacle portion 10 comprises generally triangular webs 24, 24' which extend from the plate-like sections 16, 16' to the pin-receiving end 28 (FIG. 3). The convergent side edges 26, 26' of the webs 24, 24' have sidewalls 30, 30' extending therefrom with the sidewalls of the upper web 24 being opposed to, and in alignment with, the sidewalls 30' of the lower web 24'. These sidewalls are of decreasing height with increasing distance from the pin-receiving end 28 and their upper edges are substantially against each other at the pin-receiving end 28.

Figure 6:
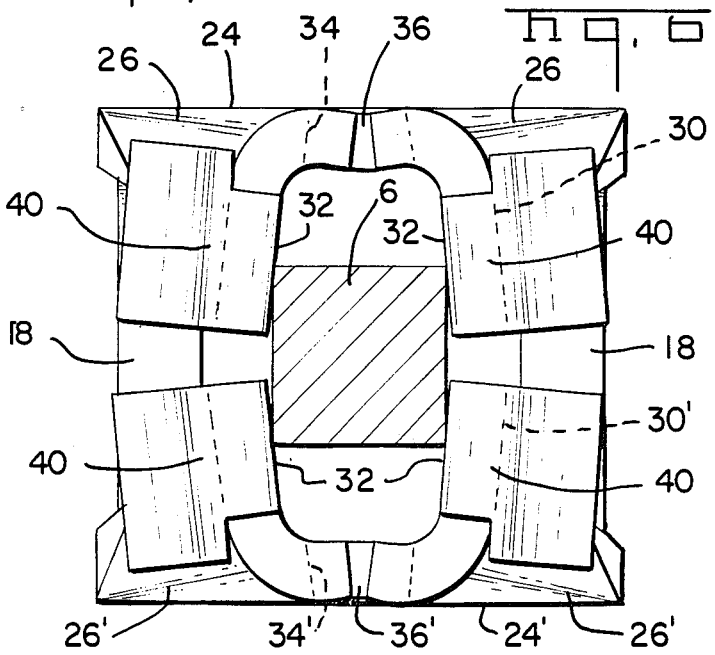
FIG. 6 is a view similar to FIG. 5 but showing a contact pin inserted into the receptacle.

The opposed sidewalls 30, 30' on each of the webs 24, 24' have opposed internal surfaces 32 (FIG. 6) and these surfaces serve as the contact surface portions at the pin-receiving end for the post 6. Each of the webs has a receptacle slot 34, 34' which extends from the pin-receiving end towards the intermediate portion 16, 16'. The slot 34 in the upper web 24 extends to a shear line 36 which in turn extends to the pin-receiving end. The slot 34' in the lower web 24' is relatively longer than the slot in the upper web. The length and width of slots 34 and 34' can be varied to generate different contact forces. The reason for this difference is that a retention lance 22 is provided in the intermediate portion 16 adjacent to the upper web 24 and the slot must be relatively shorter for that reason. The slot is designed, however, so that the two arms, that is the two webs and their sidewalls, will behave predictably when the pin is inserted into the receptacle. As shown in FIG. 6, however, the width of both slots 34 and 34' can be less than the width of the pin or post 6 engaged by the receptacle. The webs 24 and 24' can thus be sturdier since less material need be removed to form slots 34 and 34'. These sturdier webs which can withstand greater stresses mean that a greater contact force can be generated and have greater cross section to carry higher current levels.

The sidewalls of both arms have leading edges 38 at the pin-receiving end and integral ears 40 extend divergently from these leading edges. These ears provide lead-in surfaces for the pin which guide the pin into the receptacle along the axis thereof.

The slots 34, 34' serve to divide each of the webs 24, 24' into two sections *25a, 25b, 25a', 25b'*, each section comprising a portion of the web which extends from the slot 34, 34' to the adjacent sidewall and includes the integral sidewalls 30, 30' on each side of the slot. The bend lines 55 between the webs 24, 24' and respective sidewalls 30, 30' extends obliquely relative to slots 34, 34'. These two sections of each of the arms which extend from the intermediate portions 16, 16' behave in a predictable manner when the contact pin is inserted as will be described below and give rise to relatively high contact forces in the receptacle.

It will be apparent from the foregoing that the receptacle portion of the terminal comprises two arms which are substantial mirror images of each other. Each of the arms has a web 24, 24' having sidewalls 30, 30' and a receptacle slot 34, 34'. Each arm, in turn, comprises two side-by-side sections which are also mirror images of each other.

The housing 4 is in many respects similar to the housing shown in U.S. Pat. No. 4,159,158 and need not be described in detail. Indeed the terminals described herein can be used in these housings instead of the terminals shown in U.S. Pat. No. 4,159,158. The housing has a mating end 42, a wire-receiving end 44, sidewalls 46, 48, and endwalls 50. The terminal-receiving cavities 52 extend through the housing from the end 44 to the end 42 and upon insertion of the terminals into the cavities, the lance 22 of each terminal enters a window 54 in the sidewall 46 thereby to retain the terminal in the cavity. The sidewall is relieved as shown at 56 to permit movement of a wire laterally of its axis and into the wire-receiving slots 20, 20' of each terminal. The cavities 52 in general conform to the external dimensions and shape of the terminals as shown in FIG. 2. The cavity walls are not relied upon to support the terminal when the terminal is stressed by insertion of a contact pin.

Figure 4:
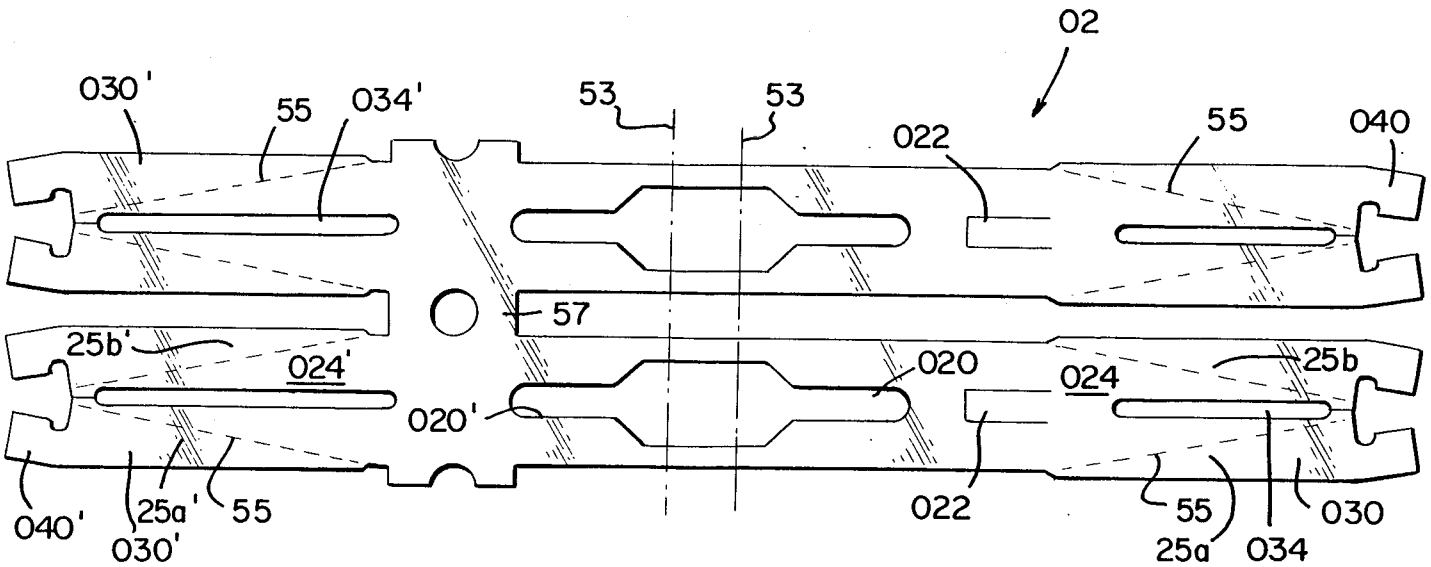
FIG. 4 is a plan view showing a portion of a strip of stamped blanks from which terminals in accordance with the invention are formed.
Figure 5:
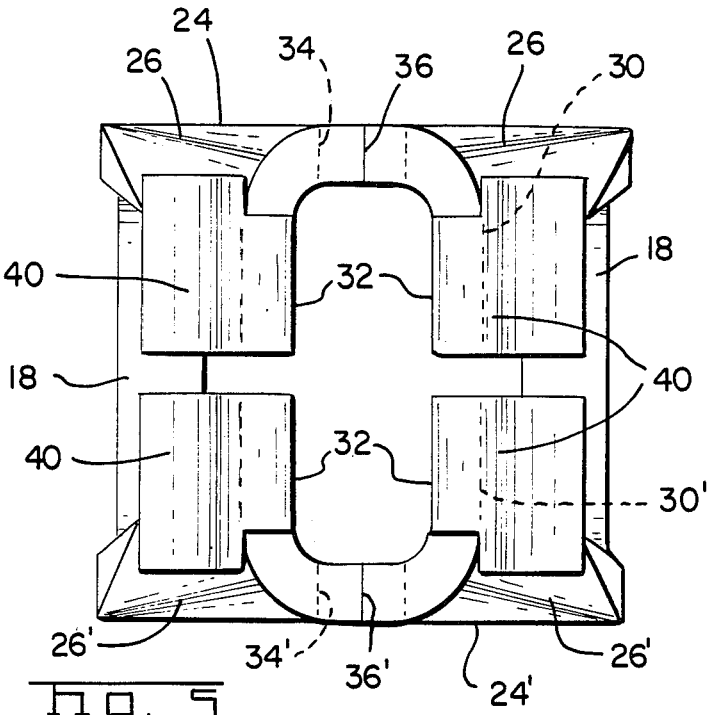
FIG. 5 is a frontal view looking in the direction of the arrows 5—5 of FIG. 3.

Terminals 2 are produced from flat blanks, a short section of a strip of such blanks being shown in FIG. 4. The blanks are in side-by-side relationship and are connected to each other by integral connecting sections 57 which are sheared out when the terminals are separated from each other and inserted into the cavities of a connector housing. In FIG. 4, the parts of the blank are identified by the same reference numerals, with a zero placed in front of each numeral, as those used to identify the parts of the formed, finished terminal shown in FIGS. 1 and 3. The finished terminals are produced by folding the terminals along two fold lines shown at 53 in FIG. 4 so that the two arms of the terminal will result. The sidewalls 30, 30' are produced by bending the blanks along the bend lines indicated at 55 to form the sidewalls 30, 30'.

Figure 7:
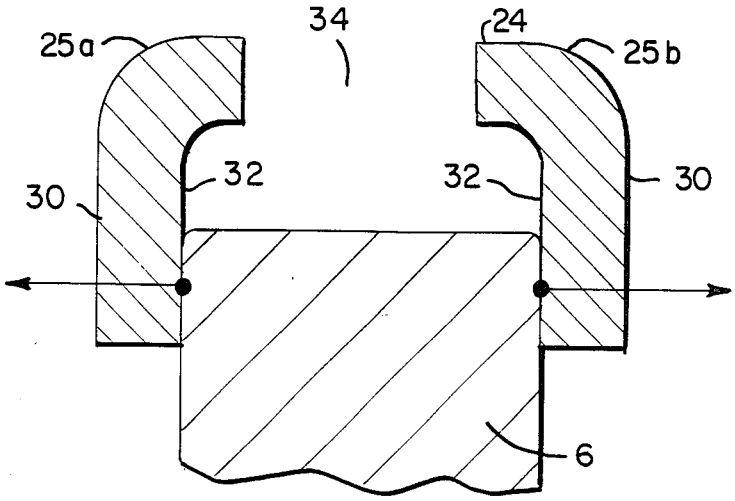
FIGS. 7 and 8 are diagrammatic views which illustrate the manner in which one of the arms of the receptacle portion of the terminal is deflected when a terminal pin is inserted.
Figure 8:
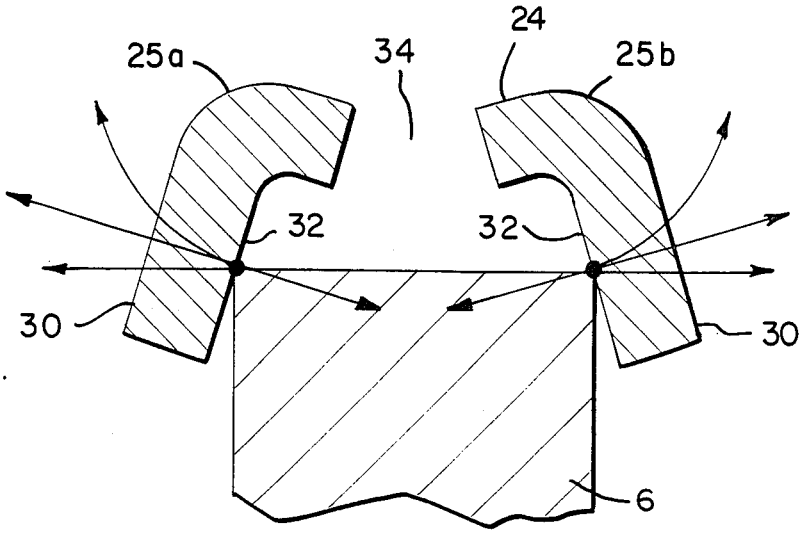

FIGS. 7 and 8 illustrate the manner in which the contact forces are developed when a terminal pin is inserted into a receptacle of a terminal in accordance with the invention. These figures show in cross section only one of the arms, that is only one of the webs and its attached sidewalls. The lower or opposite arm would be deformed in the same manner as the upper arm illustrated. These views are highly exaggerated for purposes of illustration.

When the tapered leading end of the terminal pin 6 is initially inserted into the entrance portion of the terminal and guided by the ears 40, the opposite sides of the pin move against the opposed contact surfaces of each of the two sections as shown in FIG. 7. The pin thus tends to spread the two sections apart as indicated by the arrows of FIG. 7; in other words, the leading end of the pin tends to act as a wedge and to spread the two sections so that the width of the slot 34 would be expected to increase. This spreading of the two sections gives rise to a mode of stressing which is referred to as planar stressing of the web, in other words, the type of stresses which would also be developed if a wedge were driven into the slot in the plane of the web. To a large extent, these stresses are concentrated at the root of the slot 34.

The sides of the pin engage the sidewalls, that is the receptacle contact surface portions, at a location spaced from the plane of the web and as a result, the two sections are tortionally stressed as indicated in FIG. 8. That is, the two sections are rotated in opposite rotary directions as indicated by the arrows of FIG. 8. These torsional stresses are distributed along the length of each of these sections and result in the storing of additional energy in the terminal which gives rise to an augmented contact force. When the post is fully inserted, the sideawlls engage the post, in the case of the square post, at the corners thereof as shown so that a high unit pressure is achieved.

When static conditions are achieved, after full insertion of the terminal pin, the contact force is thus the result of two modes of stress in the arm shown in FIGS. 7 and 8. The two sections 25*a*, 25*b*, 25*a'*, 25*b'* of each arm are spread apart and energy from this mode of stressing is effective to exert one component of the contact force of the receptacle on the inserted post. The torsional stressing results in the storing of additional energy which results in the production of another component so that the total contact force exerted is the summation of the two components. In the actual terminal, four sections are provided, two in the upper arm and two in the lower arm, and each of these sections is flexed in torsion so that four contact zones are produced which are more or less independent of each other.

In the foregoing discussion, the two modes of stressing the receptacle are discussed independently of each other. However, when the pin is inserted, it is more likely that both modes of stressing will be developed at about the same time. In other words, as the leading end of the pin is inserted, the spreading action takes place but at the same time the torsional deformation also takes place. The relative contributions of the planar and torsional stressing modes will vary with the design features and dimensions of the terminal. Under some circumstances, the contribution of the planar stressing mode might be slight to the point of being insignificant, for example, where the web is relatively long and narrow at its inner end. Alternatively, the contribution of the torsional mode of stressing might be minimized to the point of virtual insignificance and the planar forces maximized. The latter alternative (maximized planar stress) can be achieved by designing the receptacle with the contact surfaces very close to the surface of the web so that the moment arm (the distance from the web to the contact surfaces) is very short and the resulting torsional stresses would be very low. In this embodiment, the two sections would be two cantilever beams which would be deflected in their own planes. These beams could be designed to produce a high contact force if desired. Also the slot could advantageously be a simple shear line in order to maximize the amount of metal in the beams and thereby produce a high contact force relative to the dimensions of the terminal.

Terminals in accordance with the invention are well suited for high amperage type applications for the reason that high contact pressures are obtained and for the additional reason that each terminal contains a maximum amount of material so that maximum cross-sectional area is available to carry the current. The latter feature is apparent from an inspection of the blank, FIG. 4, which shows that each terminal is of substantially uniform width between its ends since the sidewalls 30 of each of the arms are available for carrying current as well as the web portions of the arms.

Figure 9:
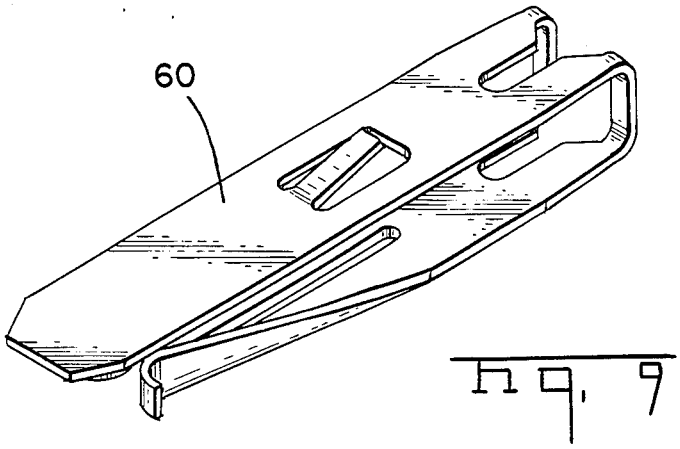
FIG. 9 is a perspective view of an alternative embodiment.

FIG. 9 shows a perspective view of an alternative embodiment which also has two arms, one of which is as described above while the other of which comprises a simple flat plate 60. This embodiment can be used where requirements, as regarding current carrying capacity, are not unduly strict. It should also be mentioned that terminals in accordance with the invention might have only a single arm, that is a single web as described above having sidewalls between which an inserted post would be received. Obviously, an embodiment of this type would be intended for usage under conditions of lesser severity.

I claim:

1. An electrical terminal, the terminal being of stamped and formed sheet metal and having a receptacle end portion, an intermediate portion, and a connecting end portion, the intermediate portion being between the end portions, the receptacle end portion having a pin receiving end and having receptacle contact surface portions for establishing electrical contact with a contact pin, the terminal being characterized in that:

the receptacle end portion comprises two arms which extend from the intermediate portion to the pin receiving end, the arms defining a receptacle for a contact pin, the receptacle having a receptacle axis which extends between the two arms from the pin receiving end towards the intermediate portion, one of the arms comprises a web having side edge portions and having sidewalls extending from the side edge portions towards the other arm, the sidewalls having opposed surfaces, the receptacle contact surface portions being on the opposed sidewall surface portions, a receptacle slot is provided in the web, the receptacle slot extending from the pin receiving end towards the intermediate portion and being located centrally between the sidewalls, the slot serving to divide the web into a pair of side-by-side sections, each section comprising one of the sidewalls and the portion of the web which is between the one sidewall and the receptacle slot whereby, upon insertion of a pin into the receptacle, the leading end of the pin contacts the receptacle contact portions and the receptacle is deformed by planar deformation and stressing of the web in its own plane and additionally by torsional deformation and stressing of the first and second sections in opposite rotary directions with respect to the receptacle axis, and after insertion of the pin, the receptacle exerts contact forces on the pin which are the summation of the contact forces exerted as a result of the planar stressing of the web and as a result of the torsional stressing of the sections.

2. An electrical terminal as set forth in claim 1 characterized in that the other arm is similar to the one arm.

3. An electrical terminal as set forth in claim 1 characterized in that the other arm is a flat plate-like arm.

4. An electrical terminal as set forth in claim 1 characterized in that the web is flat and has oppositely facing major surfaces, the major surfaces being the surfaces of the sheet metal from which the receptacle was stamped and formed, the web having side edges, the sidewalls being integral with the side edges and being bent laterally of the plane of the web, the receptacle contact portions being spaced from the plane of the web.

5. An electrical terminal as set forth in claim 4 characterized in that the receptacle has an integral lead-in portion at the pin-receiving end, the lead-in portion having lead-in surfaces which extend divergently from the sidewalls and divergently away from the pin-receiving end, whereby, a pin being inserted is guided along an insertion path which extends between the opposed internal sidewall portions of the receptacle.

6. An electrical terminal as set forth in claim 5 characterized in that the sidewalls have leading edges at the pin receiving end, the leading edges extending normally of the plane of the web, the lead-in portion comprising divergent ears which extend from the leading edges of the sidewalls.

7. An electrical terminal as set forth in claim 4 characterized in that the sidewalls extend from a location adjacent to the pin-receiving end at least partially to the intermediate portion.

8. An electrical terminal as set forth in claim 4 characterized in that the sidewalls extend divergently towards the intermediate portion of the receptacle, the web being of increasing width, as measured between the opposed surfaces of the sidewalls, with increasing distance from the pin-receiving end.

9. An electrical contact terminal as set forth in claim 1 characterized in that the web is a first web and the sidewalls are first sidewalls, the receptacle having a second web having opposed second sidewalls extending from the side edges of the second web, the second web being in opposed spaced relationship to the first web, the first and second sidewalls being opposed to, and extending towards, each other, the pair of side-by-side sections being a first pair of sections, the receptacle having a second pair of side-by-side sections by virtue of the second web and second sidewalls, the second sidewalls having receptacle contact surfaces thereon whereby the receptacle has redundant contact surfaces.

10. An electrical terminal having an integral receptacle which is intended to receive a contact pin, the terminal being of stamped and formed sheet metal, the receptacle having a pin-receiving end, and receptacle contact portions which establish electrical contact with a contact pin upon insertion of the pin into the receptacle, the receptacle being characterized in that:

the receptacle comprises a web and opposed sidewalls on each side of the web, the web extending from a location adjacent to the pin-receiving end, the sidewalls having opposed internal sidewall portions adjacent to the pin-receiving end, the receptacle contact portions being on the opposed internal sidewall portions, a receptacle slot is provided in the web, the receptacle slot extending from the pin-receiving end, the slot being located substantially medially between the sidewalls to form side-by-side sections, each section comprising one of the sidewalls and a portion of the web which extends from the sidewall to the slot, whereby, upon insertion of a pin into the receptacle, the leading end of the pin contacts the receptacle contact portions and the receptacle is deformed by torsional deformation and stressing of the first and second sections in opposite directions with respect to the axis of the receptacle, and after insertion of the pin, the receptacle exerts contact forces on the pin which are a result of the torsional stressing of the sections.

11. An electrical terminal as set forth in claim 10 characterized in that the receptacle comprises two arms, the web comprising the first arm, the second arm extending beside the first arm.

12. An electrical terminal as set forth in claim 11 characterized in that the second arm comprises a plate-like member.

13. An electrical terminal as set forth in claim 11 characterized in that the second arm is similar to the first arm and is in opposed substantial mirror image relationship to the first arm.

14. An electrical terminal as set forth in claim 13 characterized in that a contact pin is inserted into the receptacle, the receptacle being resiliently deformed by torsional deformation and stressing of the first and second sections in opposite rotary directions with respect to the axis of the receptacle.

15. An electrical terminal as set forth in claim 14 characterized in that the receptacle is resiliently deformed by planar deformation and stressing of the web in its own plane.

16. An electrical terminal as set forth in claim 10 wherein the sidewalls are formed transversely relative to the web about a bend line extending obliquely relative to the slot.

17. An electrical terminal having an integral receptacle which is intended to receive a contact pin, the terminal being of stamped and formed sheet metal, the receptacle having a pin receiving end and an inner end portion, the receptacle having receptacle contact portions which establish electrical contact upon insertion of the pin into the receptacle, the receptacle being characterized in that:

the receptacle comprises a plate like member having one end which is the pin receiving end and having side edges which extend from the one end to the inner end portion, the web member has sidewalls extending from the side edges, the sidewalls being proximate to the one end and having opposed sidewall surfaces, the receptacle contact portions being on the opposed sidewall surfaces, the web member is divided into sections by a dividing line which extends from the pin receiving end toward the inner end portion, the dividing line being between the side edges, each of the sections being a cantilever spring arm which is deflectable in its own plane away from the other cantilever spring arm whereby, upon insertion of a contact pin into the receptacle, the pin engages the opposed sidewall surfaces and the cantilever arms are flexed apart thereby giving rise to contact forces at the receptacle contact portions.

18. An electrical terminal as set forth in claim 17 characterized in that the dividing line is a shear line.

19. An electrical terminal as set forth in claim 17 characterized in that the dividing line is a slot.

20. An electrical terminal as set forth in claim 17 characterized in that a terminal pin is coupled to the receptacle, the terminal pin being between the receptacle contact portions and against the web, the cantilever spring arms being deflected away from each other substantially in their own planes by virtue of the force imposed on the contact surface portions by the pin.

21. An electrical terminal having a receptacle portion for establishing electrical contact with a contact pin, the receptacle portion comprising at least one planar web with sidewalls extending from opposite edges of the planar web, the sidewalls extending transversely relative to the planar web and having opposed spaced apart contact surfaces, the contact surfaces being disposed to engage the contact pin when positioned adjacent one surface of the planar web; the planar web having a slot extending inwardly from one end, the slot having a width less than the width of the pin and extending generally parallel to the pin positioned between the contact surfaces whereby the planar web and the sidewalls are stressed outwardly upon insertion of a contact pin between the contact surfaces, with greater contact forces being developed in the planar web because of the relatively narrow width of the slot.

* * * * *